US010366602B2

(12) United States Patent
O'Shea et al.

(10) Patent No.: US 10,366,602 B2
(45) Date of Patent: Jul. 30, 2019

(54) INTERACTIVE MULTI-TOUCH REMOTE CONTROL

(71) Applicant: Abalta Technologies, Inc., Torrance, CA (US)

(72) Inventors: Michael O'Shea, Rancho Palos Verdes, CA (US); Pavel Stankoulov, San Diego, CA (US)

(73) Assignee: Abalta Technologies, Inc., San Diego, CA (US)

( * ) Notice: Subject to any disclaimer, the term of this patent is extended or adjusted under 35 U.S.C. 154(b) by 0 days.

(21) Appl. No.: 14/283,139

(22) Filed: May 20, 2014

(65) Prior Publication Data

US 2014/0340204 A1 Nov. 20, 2014

Related U.S. Application Data

(60) Provisional application No. 61/825,493, filed on May 20, 2013.

(51) Int. Cl.
*G08C 17/02* (2006.01)

(52) U.S. Cl.
CPC ..... *G08C 17/02* (2013.01); *G08C 2201/112* (2013.01); *G08C 2201/114* (2013.01)

(58) Field of Classification Search
CPC ..... G08C 17/02; G08C 2201/112; G08C 2201/114; G06F 3/0482; G06F 3/0488; G06F 3/04883; G06F 2203/04806; G06F 3/0481; G06F 3/04842; G06F 3/0485; G06F 3/04845; G06F 19/00; G06F 2203/04808; G06F 3/041; G06F 3/04847; G06F 17/30244; G06F 3/04886; G06F 17/3064; G06F 17/30675; G06F 17/30696; G06K 9/4671
(Continued)

(56) References Cited

U.S. PATENT DOCUMENTS 8,009,147 B2 8/2011 Chang et al.
8,054,294 B2 11/2011 Sakai et al.
(Continued)

FOREIGN PATENT DOCUMENTS

WO 2011046823 A1 4/2011
WO 2012121814 A1 9/2012
WO 2013179636 A1 12/2013

*Primary Examiner* — Yong Hang Jiang
(74) *Attorney, Agent, or Firm* — Genius Patent APC; Bruce Hare

(57) ABSTRACT

A remote controller that interacts with a system under control (SUC) includes: at least one input adapted to receive data from a user; a command interpreter adapted to evaluate data received via the at least one input and determine whether the received data is associated with a remote command from among a set of remote commands associated with the SUC; at least one communication element adapted to send remote commands to the SUC; and at least one haptic feedback element adapted to provide feedback to the user, where the SUC is an in-vehicle system including a display. An automated method includes: generating a list of recognizers; passing user input event data to the recognizers; determining a status for each recognizer; identifying a single recognizer based on the status, and retrieving a command associated with the single recognizer, where the input event is associated with an in-vehicle system having a display.

9 Claims, 14 Drawing Sheets

(58) Field of Classification Search
USPC ..... 340/12.54
See application file for complete search history.

(56) References Cited

U.S. PATENT DOCUMENTS

| | | | | |
|---|---|---|---|---|
| 8,150,387 | B2 | 4/2012 | Klein et al. | |
| 8,339,369 | B2 | 12/2012 | Nezu et al. | |
| 8,363,009 | B1 | 1/2013 | Queru | |
| 8,677,285 | B2 * | 3/2014 | Tsern | G04G 21/08 715/702 |
| 9,864,504 | B2 * | 1/2018 | Park | G06F 3/0488 |
| 2004/0242278 | A1 * | 12/2004 | Tomoda | G08C 17/02 455/563 |
| 2005/0125235 | A1 | 6/2005 | Lazay et al. | |
| 2007/0144723 | A1 * | 6/2007 | Aubertin | B60H 1/00642 165/202 |
| 2007/0229465 | A1 * | 10/2007 | Sakai | G08C 17/00 345/173 |
| 2008/0034081 | A1 * | 2/2008 | Marshall | G08C 17/02 709/223 |
| 2008/0168501 | A1 * | 7/2008 | Migos | H04N 5/50 725/46 |
| 2009/0040289 | A1 * | 2/2009 | Hetherington | H04N 7/142 348/14.12 |
| 2009/0085877 | A1 * | 4/2009 | Chang | G06F 3/0488 345/173 |
| 2009/0221321 | A1 * | 9/2009 | Fields | H04M 1/576 455/552.1 |
| 2011/0279224 | A1 | 11/2011 | Jang | |
| 2012/0057081 | A1 * | 3/2012 | Petersson | G06F 3/04883 348/734 |
| 2012/0144299 | A1 | 6/2012 | Patel et al. | |
| 2013/0039632 | A1 * | 2/2013 | Feinson | H04N 5/77 386/223 |
| 2014/0038527 | A1 | 2/2014 | Chen | |

* cited by examiner

INTERACTIVE MULTI-TOUCH REMOTE CONTROL

CROSS-REFERENCE TO RELATED APPLICATIONS

This application claims priority to U.S. Provisional Patent Application Ser. No. 61/825,493, filed on May 20, 2013.

BACKGROUND OF THE INVENTION

Many vehicles (e.g., automobiles, recreational vehicles, planes, buses, etc.) include infotainment or other systems that may include one or more display elements. Such systems may be used to provide multimedia content (e.g., music, video, etc.), various services (e.g., navigation, concierge, security, communications, etc.), and/or other features (e.g., games, media, etc.). Many users may wish to use a remote control (or "controller") with such systems. Furthermore, some systems might not include a touch screen or other convenient input, and/or may be placed in a position that is not reachable by a user (e.g., automobile systems that are not reachable by the driver), thus effectively requiring use of some kind of remote control.

In addition, many users may desire a controller that is able to be used to control other systems than vehicle-based systems, such as home entertainment systems, medical devices or systems, computer systems (e.g., when giving a presentation), etc.

Many existing controllers provide only visual feedback, requiring a user to look at the controller in order to enter a command, to verify that the command was received properly, and/or to receive other feedback regarding the command. Under various conditions, such requirements may be distracting or inconvenient (e.g., when giving a presentation), unsafe (e.g., when driving an automobile), difficult (e.g., when using a remote-control in a low-light setting), and/or otherwise be undesirable to a user.

Furthermore, many existing controllable systems may each be associated with a dedicated controller that operates only with that system. Users may find it inefficient and inconvenient to store, monitor, and become proficient at using such varied controllers.

Therefore there exists a need for an adaptive, interactive remote controller able to be used with multiple external systems and provide non-visual feedback to a user that is implemented using a non-dedicated mobile device.

BRIEF SUMMARY OF THE INVENTION

Some embodiments provide an adaptive interactive remote controller. The remote controller may be implemented using widely available (and routinely carried) mobile devices such as smartphones and tablets. Such a controller may include various user interaction features (e.g., touchscreens, display screens, audio outputs, speakers, microphones, buttons, keypads, motion sensing elements, haptic feedback elements, etc.). The controller may be adapted to communicate with multiple external systems (e.g., infotainment systems, medical devices, etc.) across various appropriate pathways (e.g., wired connections such as universal serial bus (USB) connections, wireless connections such as Bluetooth®, etc.).

Some embodiments may provide haptic feedback (or other non-visual feedback) such that a user does not have to look at the controller during use. Such feedback may include, for instance, vibration, audio feedback, etc.

When using a multi-touch enabled device, some embodiments may allow various multi-touch commands. Such commands may be associated with at least two touch regions. Such commands and regions may be defined such that a user is able to enter commands using, for instance, all fingers and a thumb on one hand (of course different commands may use a subset of digits).

A first exemplary embodiment provides a remote controller adapted to interact with a system under control (SUC). The remote controller includes: at least one input adapted to receive data from a user; a command interpreter adapted to evaluate data received via the at least one input and determine whether the received data is associated with a remote command from among a set of remote commands associated with the SUC; at least one communication element adapted to send remote commands to the SUC; and at least one haptic feedback element adapted to provide feedback to the user.

A second exemplary embodiment provides a mobile device application adapted to remotely control an external system. The application includes sets of instructions for: receiving an input via a user interface element of the mobile device; generating a command output based at least partly on the received input; and sending the control output to the external system.

A third exemplary embodiment provides an automated method adapted to decipher a user input event. The method includes: generating a list of active recognizers, each recognizer including a type and a set of configuration parameters; passing data associated with the user input event to each recognizer in the list of active recognizers; determining a status for each recognizer in the list of active recognizers; and identifying a single recognizer based at least partly on the status of each recognizer.

The preceding Summary is intended to serve as a brief introduction to various features of some exemplary embodiments of the invention. Other embodiments may be implemented in other specific forms without departing from the spirit of the invention.

BRIEF DESCRIPTION OF THE SEVERAL VIEWS OF THE DRAWINGS

The novel features of the invention are set forth in the appended claims. However, for purpose of explanation, several embodiments of the invention are set forth in the following drawings.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, as the scope of the invention is best defined by the appended claims.

Various inventive features are described below that can each be used independently of one another or in combination with other features. Broadly, some embodiments of the present invention generally provide ways to utilize a mobile device (e.g., a smartphone, tablet, etc.) as a remote controller for various different kinds of systems, devices, and/or components (e.g., in-vehicle infotainment systems, multi-media systems, computers, medical devices, etc.). By utilizing the advanced capabilities of the mobile devices such as multi-touch enabled screens, vibration and other haptic feedback, accelerometers and other position sensors, etc., systems may be controlled without the need to look at the controller. Such an approach is especially useful for in-vehicle applications where driver distraction may be a problem.

Mobile devices such as smartphones or tablets are ubiquitous in society and many users carry such a device at all times. These devices typically include features and components such as high-quality touchscreen displays, cameras, accelerometers, microphones, etc. Such devices may be able to receive user inputs and communicate with external systems. Such mobile devices may always be available or accessible to many users and thus may be used by some embodiments to provide a low cost, high-quality remote controller solution.

Several more detailed embodiments of the invention are described in the sections below. Section I provides a conceptual description of a system architecture used by some embodiments. Section II then describes various example touchscreen control features that may be provided by some embodiments. Next, Section III describes various alternative control features that may be provided by some embodiments. Section IV then describes interactive feedback provided by some embodiments. Next, Section V describes various methods of operation used by some embodiments. Lastly, Section VI describes a computer system which may be used to implement some embodiments of the invention.

I. System Architecture

Figure 1:
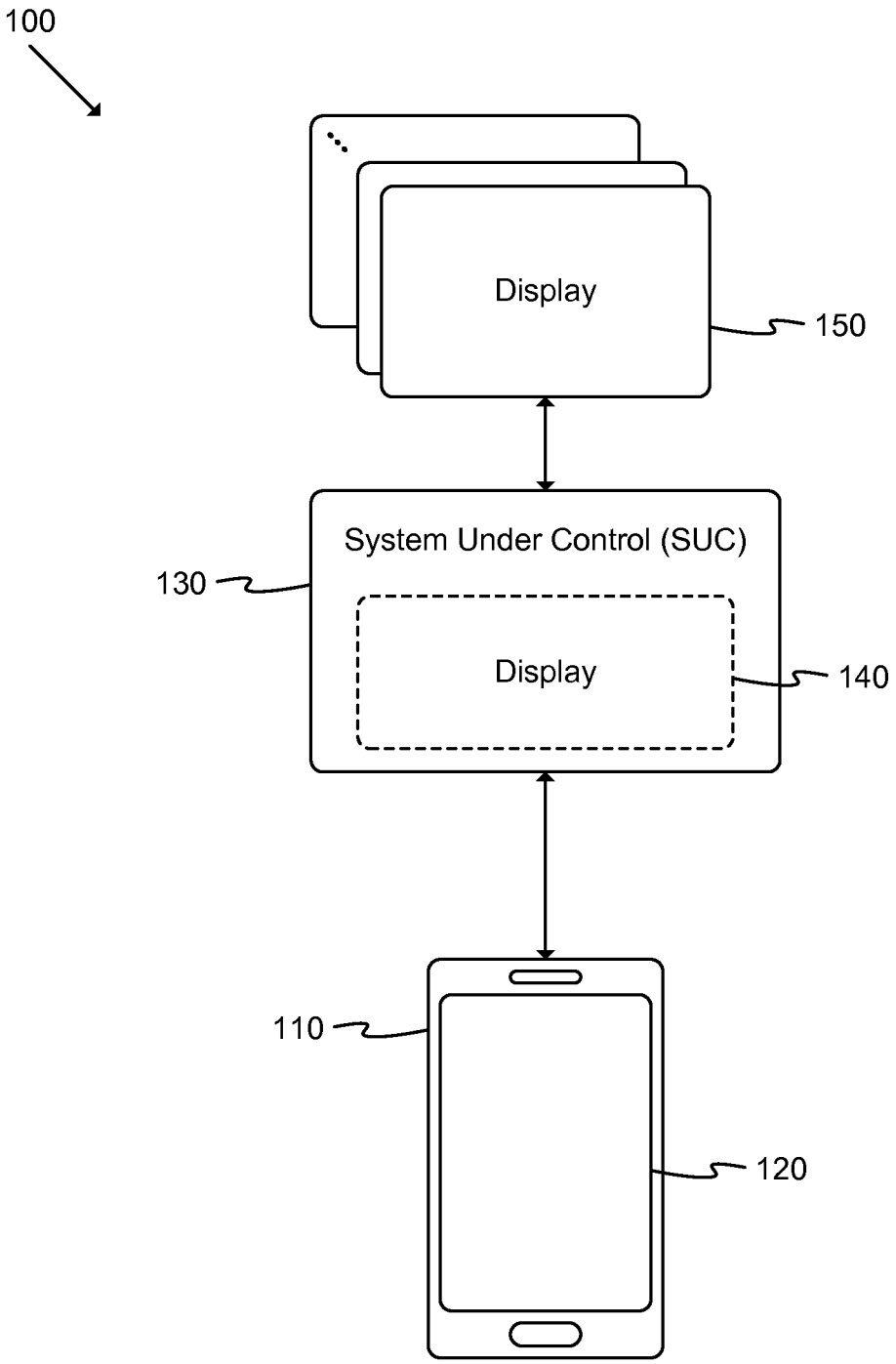
FIG. 1 illustrates a schematic block diagram of a conceptual system according to an exemplary embodiment the invention.

FIG. 1 illustrates a schematic block diagram of a conceptual system 100 according to an exemplary embodiment the invention. As shown, the system 100 may include a mobile device 110 (e.g., a smartphone, tablet, etc.) that may include at least one user interface element 120 and a system under control (SUC) 130 that may include at least one display element 140 and/or be associated with one or more external display elements 150.

In some embodiments, the mobile device 110 may execute a remote controller application (RCA) that is able to receive a user input, provide feedback and/or communicate with the SUC. One such application will be described in more detail in reference to FIG. 2 below.

Returning to FIG. 1, the mobile device 110 may be any user device that is capable of receiving user inputs and communicating commands based on those inputs to an external device or system. The user interface element 120 may be any element that is able to receive inputs from a user (e.g., a touchscreen, a keypad, one or more buttons, a microphone, position sensing elements, etc.) or provide outputs to a user (e.g., a touchscreen or display, lights or other indicators, audio outputs, etc.).

The SUC 130 may be an entertainment device or system (e.g., a TV, set-top box, Smart TV, in-vehicle infotainment system, game console, etc.), an in-vehicle system (e.g., climate control, door locks, power windows, etc.), a professional or industrial device or system (e.g., medical diagnostics equipment, medical imaging device, machinery, robots, etc.), and/or any appropriate other set(s) of devices or systems that are able to interact with a remote control. The SUC typically may include one or more computing devices that are able to communicate with the mobile device over an appropriate interface. The computing device may include a remote controller handler (RCH), which may be a software and/or hardware module that is able to receive commands from the RCA (and/or otherwise interact with the RCA).

The SUC may be associated with one or more displays 140-150. The displays may be embedded displays 140 that are included in a single unit or enclosure with the SUC 130 or the displays may be external displays 150 that may be connected using one or more cables or wireless connections. Such displays or screens may show a user interface (UI) that may be able to be manipulated by the user (and/or by the remote controller of some embodiments). The SUC 130 may also be connected to other machines, devices, and/or systems (e.g. robots with or without displays, medical devices with or without displays, etc.).

The mobile device 110 may be able to communicate with the SUC 130 via one or more wireless interfaces (e.g., Wi-Fi, Bluetooth®, near field communication (NFC), etc.), wired connections (e.g., USB, Ethernet, etc.), and/or combinations of wireless and wired interfaces and/or connections.

One of ordinary skill in the art will recognize that the example of system 100 is provided for descriptive purposes and different embodiments may be implemented in various different ways without departing from the spirit of the invention. For instance, different embodiments may utilize different communication interfaces than those described above. As another example, different embodiments may include various additional elements and/or eliminate various elements (e.g., some embodiments may not include a display associated with the SUC).

Figure 2:
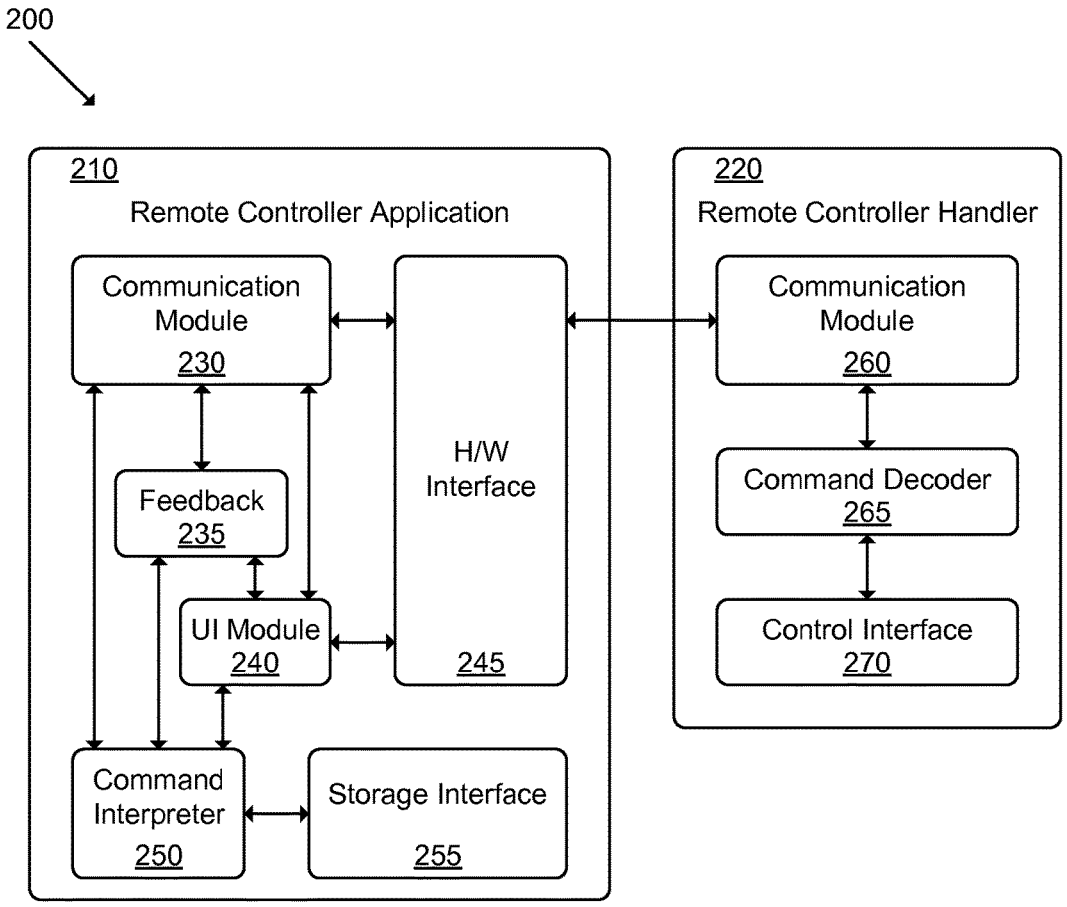
FIG. 2 illustrates a schematic block diagram of a conceptual control system according to some embodiments.

FIG. 2 illustrates a schematic block diagram of a conceptual control system 200 according to some embodiments. As shown, the system may include a remote controller application 210 and a remote controller handler 220. In some embodiments, the remote controller application 210 may be implemented using the mobile device 110 described above and the remote controller handler 220 that may be implemented using the SUC 130 and/or mobile device 110 described above.

The remote controller application 210 may include a communication module 230, a feedback module 235, a UI module 240, a hardware interface 245, a command interpreter 250, and a storage interface 255.

The communication module 230 may be adapted to generate commands to be sent to the remote controller handler 220 and/or to receive messages or other communications from the remote controller handler. The communication module 230 may forward messages to and/or relay messages from various other application components, as appropriate.

The feedback module 235 may be adapted to generate user feedback. Such feedback may be based at least partly on data received via the communication module 235, UI module 240, and/or other appropriate modules. In some embodiments, the feedback module 235 may be adapted to generate commands or instructions that may be forwarded to the UI module 240 in order to provide feedback to a user.

The UI module 240 may be adapted to generate various user interfaces (e.g., graphical UIs, touchscreen elements, etc.) and/or to receive various inputs from a user via the mobile device.

The hardware interface 245 may allow the RCA 210 to interact with various hardware elements provided by the mobile device (or other device serving as the controller). Such hardware elements may include, for instance, UI elements such as touchscreens, displays, buttons, keypads, switches, knobs, etc. In addition, such hardware elements may include various input/output elements such as microphones, cameras, speakers, audio outputs, etc. Furthermore, the hardware interface may all the RCA 210 to access resources such as communication resources (e.g., USB, Wi-Fi, Bluetooth®, NFC, etc.). In some embodiments, the hardware interface 245 may also be used to access various other components (e.g., position sensing components such as accelerometers, global positioning satellite information, vibration or other alert features, etc.).

The command interpreter 250 may be adapted to receive information collected by the UI module 240 and decipher the information to determine whether a user has attempted to enter a command. The command interpreter 250 may access saved data through the storage interface 255 to determine whether any received inputs match some command definition. In some embodiments, the command interpreter 250 may communicate with the UI module 240 and/or feedback module 235 in order to provide feedback to a user when appropriate.

The storage interface 255 may allow RCA 210 components to access local storage space available to the mobile device.

In some embodiments, the RCA 210 and RCH 220 may be combined into a single element executed by the mobile device. Such embodiments may include, for example, screen projection solutions (e.g., WEBLINK®).

The remote controller handler 220 may include a communication module 260, a command decoder 265, and a control interface 270. The communication module 260 may be adapted to communicate with the RCA communication module 230 in order to receive controller commands and/or to send messages to the RCA 210.

The command decoder 265 may be adapted to receive data from the communication module 260 and determine a command for the SUC based on the received data. Some embodiments may include a look-up table or other appropriate resource to match received command messages to available system commands.

The control interface 270 may receive system commands from the command decoder 265 and relay the commands to various system elements, as appropriate. For instance, if a command is received to skip to a next song in a playlist, the command may be relayed to a media player component provided by the SUC (or otherwise associated with the SUC).

Figure 3:
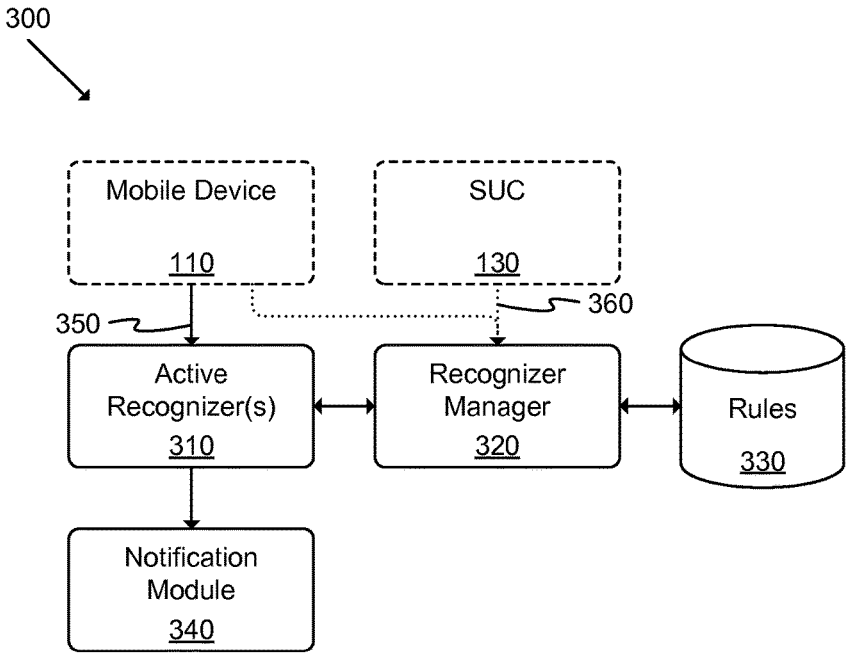
FIG. 3 illustrates a schematic block diagram of a conceptual command interpreter of some embodiments.

FIG. 3 illustrates a schematic block diagram of a conceptual command interpreter 300 of some embodiments. The interpreter is one example implementation of the interpreter 250 described above. Although in this example, the interpreter 300 may be described in reference to gesture recognition, one of ordinary skill in the art will recognize that such an interpreter may also be applied to other recognition sub-systems (e.g., device movement, sound detection, etc.).

As shown, the command interpreter 300 may include a set of active recognizers 310, a recognizer manager 320 and a set of rules 330, a notification module 1540, and a set of communication links 350-360. In addition, the interpreter 300 may be able to communicate with the mobile device 110 and/or SUC 130 (e.g., via the hardware interface 245 and communication module 230 described above).

The active recognizer(s) module 310 may monitor the currently active recognizers, i.e. those recognizers that are tracking user input events. Upon a first touch event, for instance, the module may take a list of the available recognizers from the recognizer manager 320 and pass the touch event information to each recognizer in the list. Each recognizer may analyze the event and adjust an internal state based on the analysis. If the event matches a pattern associated with a particular recognizer, the particular recognizer may be kept in the active list. Otherwise, the recognizer may be removed from the list. In this way, if one recognizer is left active then the gesture is recognized and an associated command may be passed to the notification module 340.

Commands associated with the only active recognizer may be continuously sent to the notification module 340. Thus, for instance, a rotary gesture recognizer may send associated commands. When the user releases the touchscreen (or an input event is otherwise determined to have ended), the active list may be reset.

The recognizer manager 320 is a module that may be adapted to manage all possible recognizers supported by the system. The manager may maintain a list of all recognizer modules. The manager may receive notifications from the SUC regarding the state of the SUC (e.g., over communication link 360). The manager 320 may have an associated recognizer rules configuration. The manager may define, based at least partly on the SUC state, which commands are available. The recognizer manager may manage references to the available recognizers, i.e. those allowed based on the current SUC state in the available recognizers list. Thus, only appropriate recognizers for the current context are used. Efficiency and accuracy of recognition may be improved by limiting the available recognizers in this way.

The notification module 340 may be called by the active recognizers module 310 when a single active recognizer is left and the state of the recognizer changes (e.g., an input event or gesture is recognized, new movement is detected, touch is released, etc.). The notification module 340 may then pass the recognized command and state to other system resources, as appropriate.

In some embodiments, event notifications may be sent across link 350, which may include, for instance, a message sent via a mobile device API. Such a notification may include a touch notification that includes, for instance, a number of touch points currently being pressed, a status associated with each point (e.g., up, down), and a location of each point on the screen (e.g., in x, y coordinates). Different types of events may include different types of notifications with different elements (e.g., a movement event may include information such as tilt, speed and/or acceleration of movement, direction, etc.). Also, different events may be processed in various different ways by the mobile device (and/or other system components) depending on the type of event (e.g., an audio event may be passed through a speech recognition module before a notification is generated that may include the output of the speech recognition module). The notifications may be received by the active recognizers module 310 for processing.

In some cases, the SUC 130 (and/or the mobile device 110) may send state notifications regarding the current state of the SUC 130 across link 360. Such notifications may include, for instance, the screen being shown by the SUC, a status of the SUC, etc. The notifications may be received by the recognizer manager 320 for processing.

Figure 4:
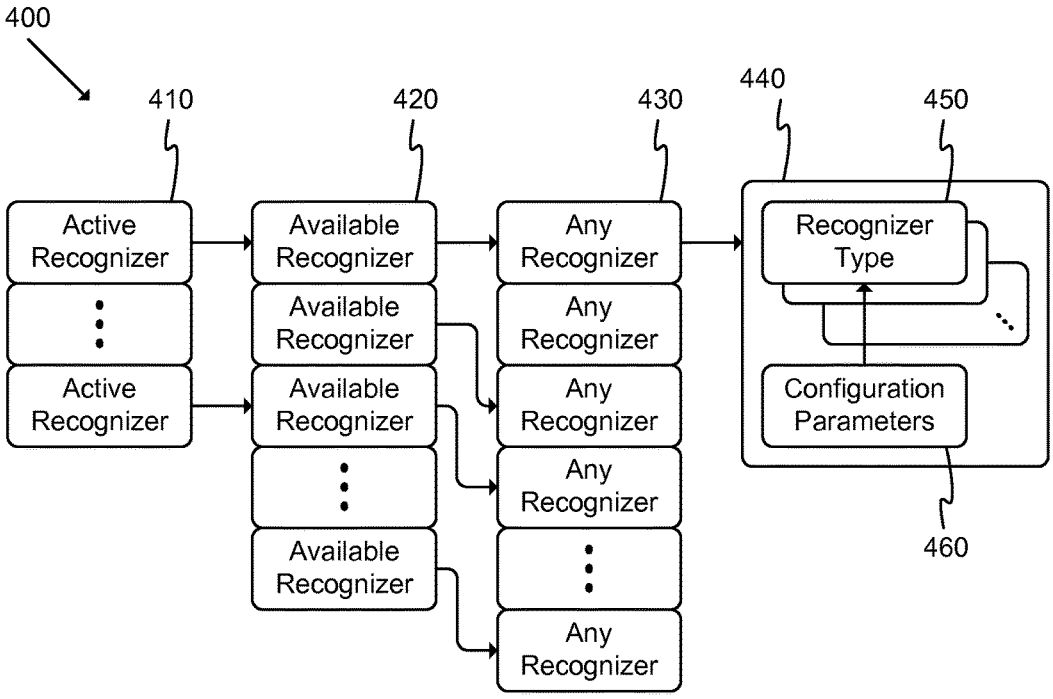
FIG. 4 illustrates a data structure diagram of various command recognizers used by some embodiments.

FIG. 4 illustrates a data structure diagram 400 of various command recognizers used by some embodiments. The interpreter 300 of some embodiments may be implemented using such data elements.

As shown, the diagram 400 includes a list of references to active recognizers 410, a list of references to available recognizers 420, and a list of references to all recognizers 430, where each recognizer 440 may be implemented using a recognizer type 450 and a set of configuration parameters 460.

Each recognizer 440 may be a module that is adapted to perform individual gesture recognition (or individual command recognition). The recognizers may conform to a common interface (e.g., as used in object oriented programming languages) and have different implementations. The recognizer configuration parameters 460 may define various recognition parameters. For instance, the parameters may define a threshold amount of movement of the touch points that is required to detect the command, number of touch points, time between the event, etc. Each active gesture recognizer may provide a current state indicating whether the recognizer is active or not. Such a state may be determined based on various appropriate factors (e.g., previous events). If active, the recognizer may receive the touch events, perform the internal analysis and either set the state to active or not active, depending on whether the events match the required criteria.

Some embodiments may include a "cancel gesture" that may allow a user to cancel event analysis. Such a gesture may be implemented as, for instance, swiping away with all fingers or swiping away outside the screen.

The above approach may be generalized for any type of recognition event. Such events could include audio events, device movement events, etc. The architecture approach may be the same, where a list of all available recognizers may be generated, available recognizers may be identified based on, for example, the SUC context (i.e. only commands that applicable to the current state of the system may be made available), and active recognizers that are currently tracking user events to determine whether a sequence of events matches the rules and configuration parameters associated with the recognize.

Some embodiments may use adaptive recognition parameters for the recognizers. The user might, for instance, be able to adjust the sensitivity of the various gesture recognizers by adjusting the configuration parameters associated with the recognizers. Some embodiments may provide a user friendly user interface that allows users to adjust such parameters.

The parameters may also be adjusted automatically by the system using feedback from the SUC. For instance, some embodiments may detect how often a user makes a mistake with given gesture. Errors can be detected if the user cancels the previous operation, either explicitly through a cancel (back) command or returning to the previous position and executing a new command. Returning to the previous position can be detected based on time (e.g., a user immediately returning to a previous command could indicate an erroneous command). If errors happen frequently enough, the system may adjust by, for instance, decreasing the sensitivity of the gesture that caused this command to reduce the false detections. Similarly, as a user operates the system over time with infrequent errors, the system may adjust by, for instance, increasing the sensitivity in order to cause faster reactions and thus improved movement efficiency.

In addition, in some embodiments command parameters may be changed based at least partly on an SUC context, if known. For instance, in some SUC states gestures may be more sensitive than the others based on the complexity of the UI or the operations associated with the state.

One of ordinary skill in the art will recognize that the examples of FIGS. 2-4 are provided for descriptive purposes and different embodiments may be implemented in various different ways without departing from the spirit of the invention. For instance, different embodiments may include various additional elements and/or eliminate various elements. In addition, although elements such as the RCA and RCH may be described as applications or similar, one of ordinary skill in the art will recognize that such components may be implemented entirely using electronic circuitry configured to provide the functionality described herein. Some such circuitry is described in reference to FIG. 16 below.

II. Touchscreen Control Features

A typical mobile device may include a high quality touchscreen. Such screens may be highly sensitive to touch and may allow various touch events and/or movements. The following sub-sections describe various control features of some embodiments that may utilize touchscreen capabilities.

Although many examples above and below refer to control of an external system or SUC, one of ordinary skill in the art will recognize that the various control features described below may also be used to control functionality associated with the mobile device. For instance, the control gestures described below may be able to be used to answer calls, skip media, etc. without any involvement of the SUC. In addition, even in cases where the SUC may be used in conjunction with a mobile device (e.g., when using a vehicle system as a hands free device), the operations of the mobile device may be controlled using the various gestures or other features described below.

A. UI Examples

Figure 5:
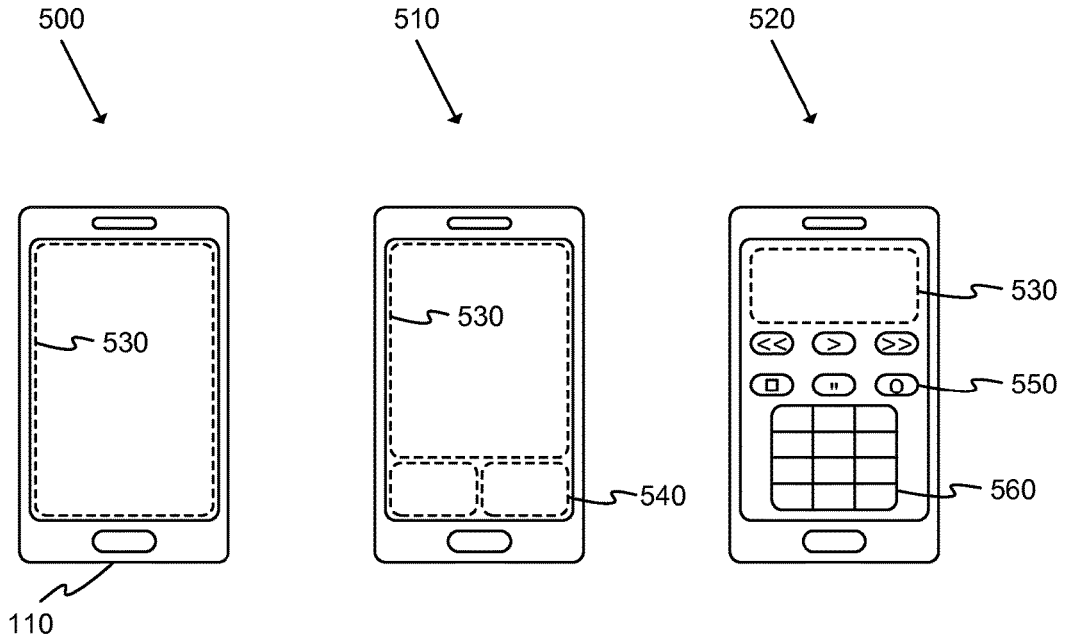
FIG. 5 illustrates front views of a mobile device as used to implement various UI features of some embodiments.

FIG. 5 illustrates front views 500-520 of a mobile device 110 as used to implement various UI features of some embodiments. Different UIs may be presented based on various appropriate factors. Such factors may be related to the SUC (e.g., device type, manufacturer, model, etc.), to the user (e.g., user selections or preferences), to the controller device (e.g., screen size, available inputs, etc.), and/or other appropriate considerations.

In the first example UI 500, the entire touchscreen 120 is used to provide a touch control area 530. Such a touch control area may serve a similar function to a laptop track pad or a touchscreen device. A user may be able to enter commands by performing actions within the touch control area (e.g., tapping, swiping, multi-finger selection, etc.). In some embodiments, the touch control area may be presented as a blank screen, single color screen, a single color entry box, and/or other appropriate representation.

In the second example UI 510, the touchscreen 120 is divided into multiple control sections include a touch control area 530 that may operate as described above and two additional areas 540. Different embodiments may include different numbers of areas defined in various ways to have different sizes, layout, etc. In this example, the two additional areas may serve as left and right "mouse buttons" when using the controller with a PC or other similar device. In the second example UI 510, the various areas may be included within a single block such as the blank screen described above, or the areas may be delineated in various appropriate ways (e.g., using borders, using a different color to indicate each area, etc.).

In the third example UI 520, the touchscreen 120 is used to display a touch control area 530 similar to that described above, several virtual buttons 550, and a keypad 560. In this example, the various control features may be displayed using various appropriate graphical elements (e.g., borders, shading, colors, etc.). In this way, a user may be able to clearly see and select among various defined options when appropriate. One of ordinary skill in the art will recognize that various configurations and combinations of elements may be used by different embodiments. In addition, some embodiments may omit any touch control area and provide a UI that include only sets of buttons, each associated with a visibly defined area of the touchscreen. In addition, some embodiments may allow users to choose from among several available control screens depending on the type of use (e.g., in-home use of a device rather than in-vehicle use, identity of user, a mode of the SUC, etc.).

One of ordinary skill in the art will recognize that the UIs of FIG. 5 are presented for example purposes only and that different embodiments may use different specific UIs. For instance, different embodiments may include different numbers of elements that may be arranged in various different ways. As another example, different embodiments may include different types of elements (e.g., a slider control versus a knob) that may be provided in various different configurations.

A. Track Pad

One way to provide a controller is to use the touchscreen on a mobile device is as a track pad similar to those available on a laptop computer. A user may drag one or more fingers along the screen surface, which may in turn move a cursor on the screen. Selection may be performed by tapping on the screen. This approach may be useful for entertainment systems or controlling generic computer systems by simulating a mouse. However, for in-vehicle systems where the user cannot be distracted and faster reaction time is needed, other approaches described herein may be better suited.

B. Touch Gestures

Some embodiments may define a set of commands such that the commands are associated with a set of gestures performed on the mobile device screen. The mobile devices have already established some commonly used conventions for gestures, such as pinch out for zoom out, pinch in for zoom in, flick for page change, etc. These gestures can be further extended to simulate physical actions such as rotation of a knob, turning a switch, page turning, etc. that don't require "aiming" at a specific control (or location) to perform the action.

Figure 6:
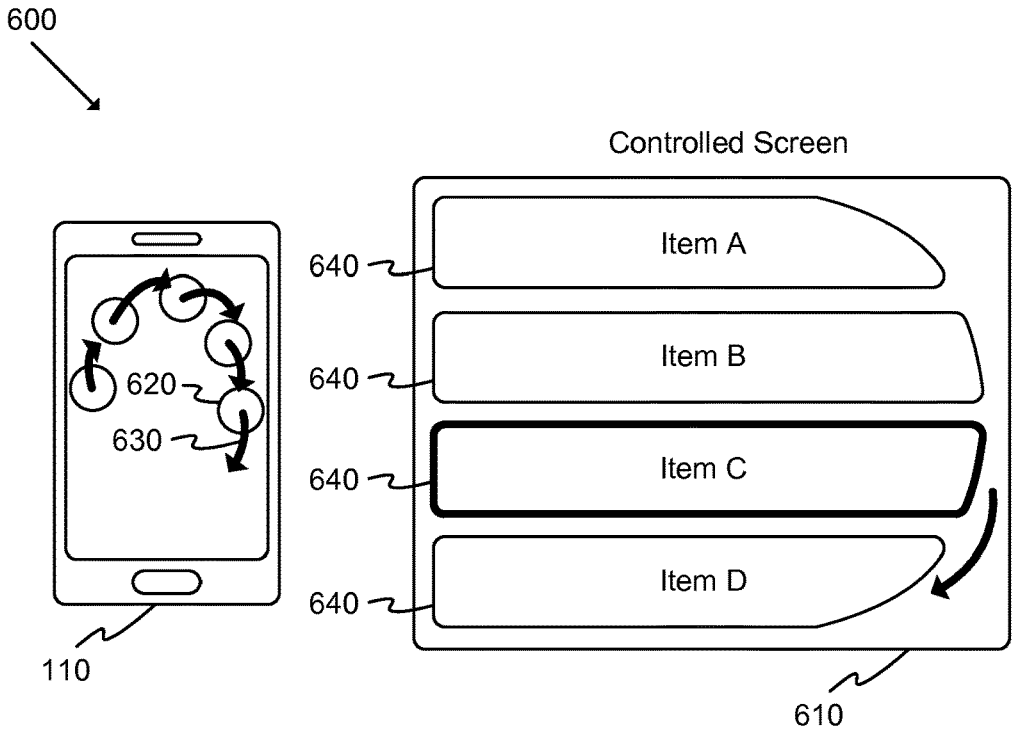
FIG. 6 illustrates an example of rotary movement control of some embodiments.

FIG. 6 illustrates an example 600 of rotary movement control of some embodiments. In the example of FIG. 6, the mobile device 110 shows a control input, while a display screen 610 associated with the SUC shows the effect of the command associated with the control input.

Some embodiments may identify touch selection regions 620 and associated hold and drag movements 630. In addition, some embodiments may be able to identify various actions (e.g., tap, double-tap, etc.) and/or movements other than hold and drag movements. Such regions and movements may be associated with finger placement and movement along a touchscreen surface.

The shape of a UI element may provide a hint to the user that rotary movement control may be allowed. In the example of FIG. 6, the rotational movement changes the focus and scrolls the list of items 640 up or down based on the direction of the rotation. On the mobile device side, the RCA may detect, for example, if three or more fingers are moving in a circular motion and then may send a rotary scroll command to the controlled system, which causes the UI to be updated. Depending on the scenario, tapping with three or more fingers may act as a select and/or enter command.

Different commands may be associated with different numbers of selection points and/or any associated movements. For instance, some commands may be associated with a single selection point and/or movement.

Furthermore, the RCA may provide a haptic feedback to the user when an element is selected and thus create the sensation of an interaction with a mechanical device.

Figure 7:
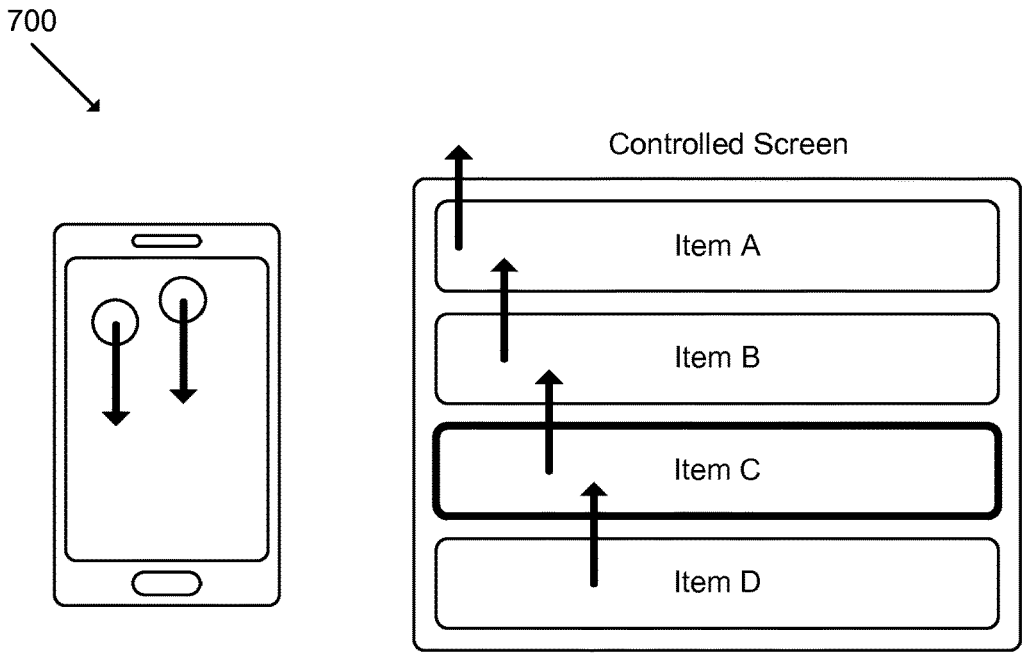
FIG. 7 illustrates another example of a gesture command used to scroll a list in some embodiments.

FIG. 7 illustrates another example 700 of a gesture command used to scroll a list in some embodiments. As above, the mobile device 110 shows a control input, while a display screen 610 associated with the SUC shows the effect of the command associated with the control input.

In the example of FIG. 7, if two fingers sliding up and/or down the touchscreen are detected, a scroll list command may be sent to the SUC. Depending on the application, tapping on the screen with two fingers may act as the select and/or enter command.

One of the advantages of using control gestures is that the gestures may be used without the need to focus or click on a specific UI element. The gesture itself determines which element is to be active. FIGS. 8-11 illustrate this approach. These figures show an example of a map screen of an in-vehicle navigation system, which has different control elements that are controlled by gestures without the need to focus on a specific element.

Figure 8:
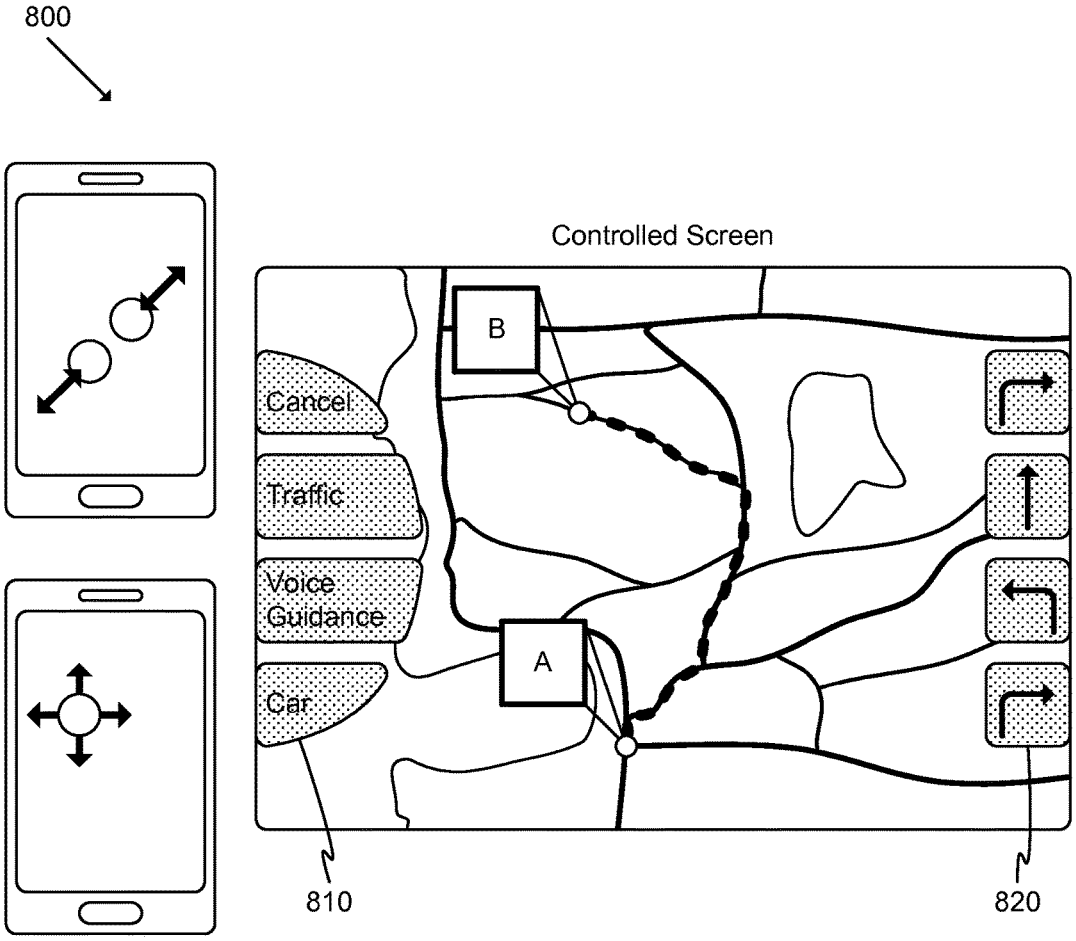
FIG. 8 illustrates an example of map zooming and scrolling provided by some embodiments.

FIG. 8 illustrates an example 800 of map zooming and scrolling provided by some embodiments. As shown, in this example the map may be zoomed in or out by pinching in and out. Alternatively, the map may be scrolled by dragging a single finger up, down, left, right. During such zoom and/or scroll operations, various UI features (e.g., buttons 810 and indicators 820) may remain stationary (and not change in size) while the map features move or zoom in the background.

Figure 9:
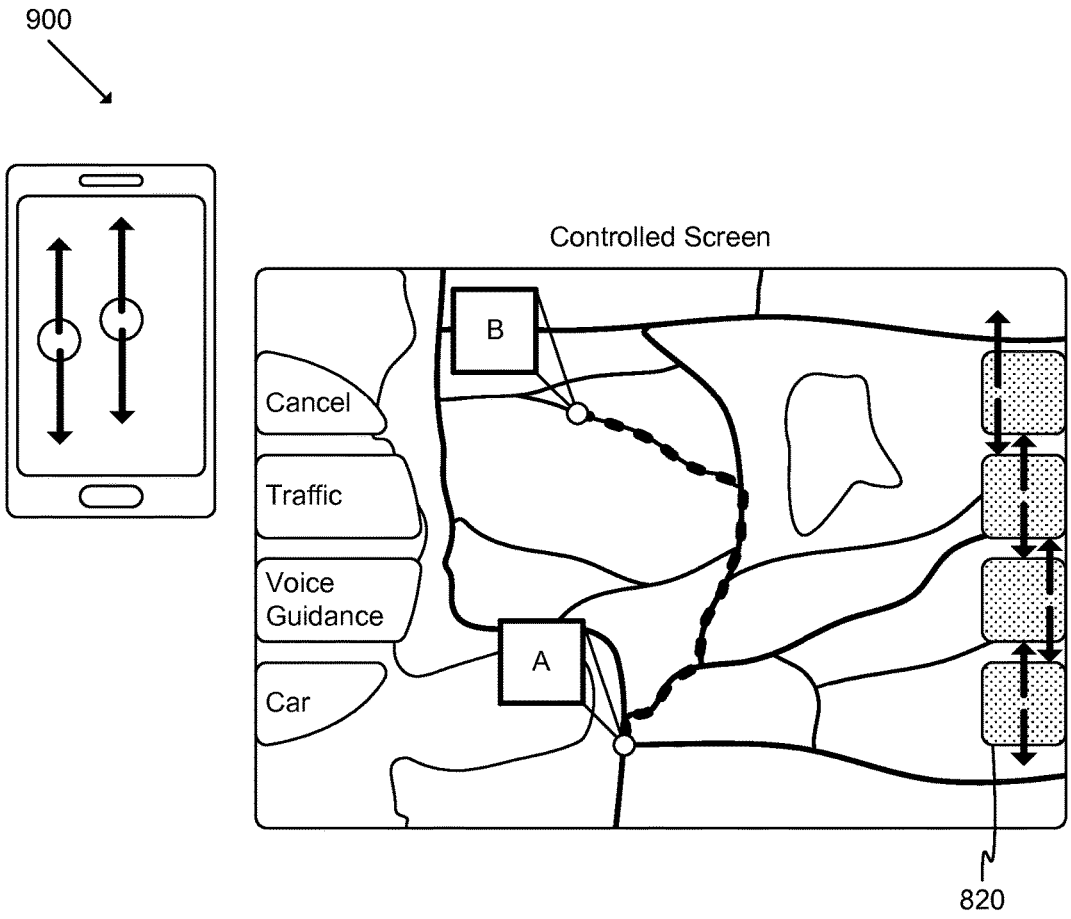
FIG. 9 illustrates another example type of control used by some embodiments on a map screen.

FIG. 9 illustrates another example 900 type of control used by some embodiments on the map screen. In this example, two-finger dragging may control the turn-by-turn list of indicators 820 on the right of the map screen. Because the turn-by-turn information has the look of a list, a user may expect the information to be scrollable with two fingers.

Figure 10:
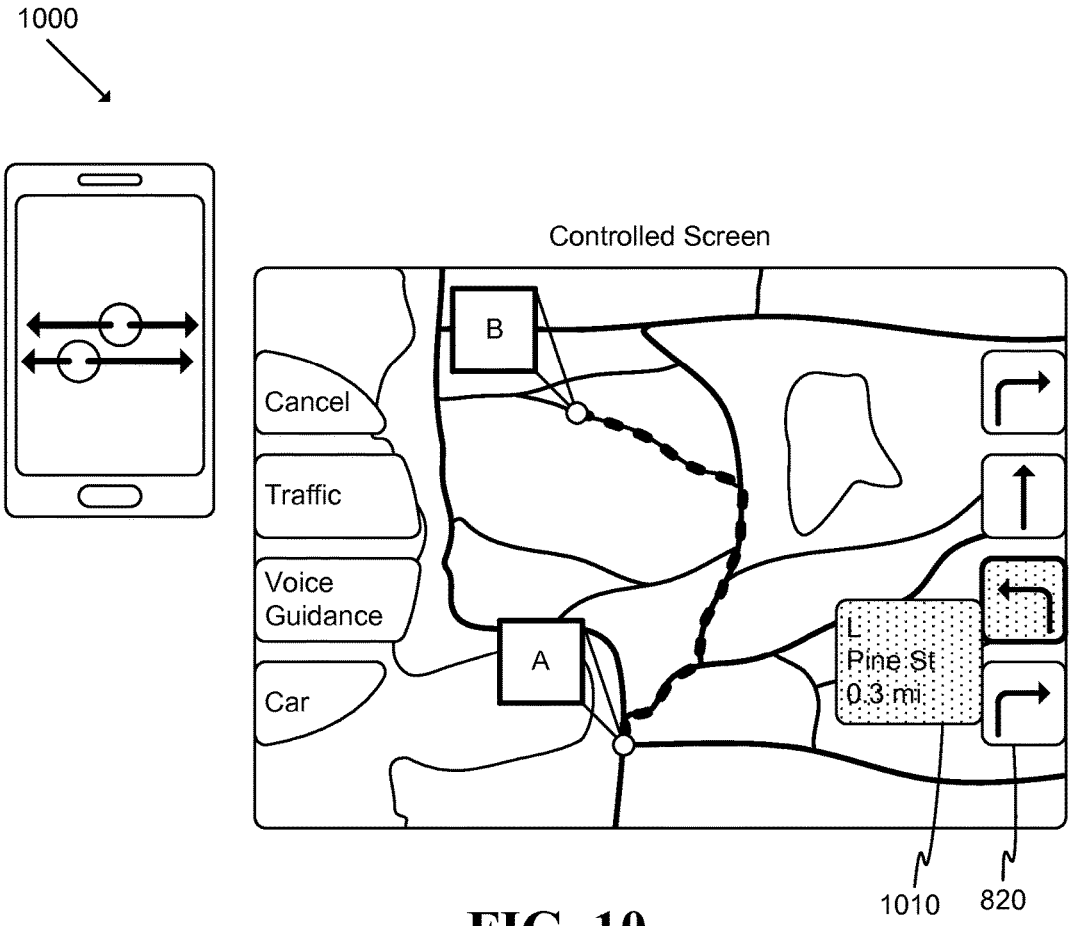
FIG. 10 illustrates another example type of control used by some embodiments to expand or collapse list items on a map screen.

FIG. 10 illustrates another example 1000 type of control used by some embodiments to expand or collapse list items on the map screen. In this example, two fingers sliding horizontally may be used to expand or collapse elements included in the list of indicators 820, where in the expanded section 1010 additional information may be shown regarding the indicator 820 (e.g. the street name and distance when the indicator relates to a driving maneuver).

Figure 11:
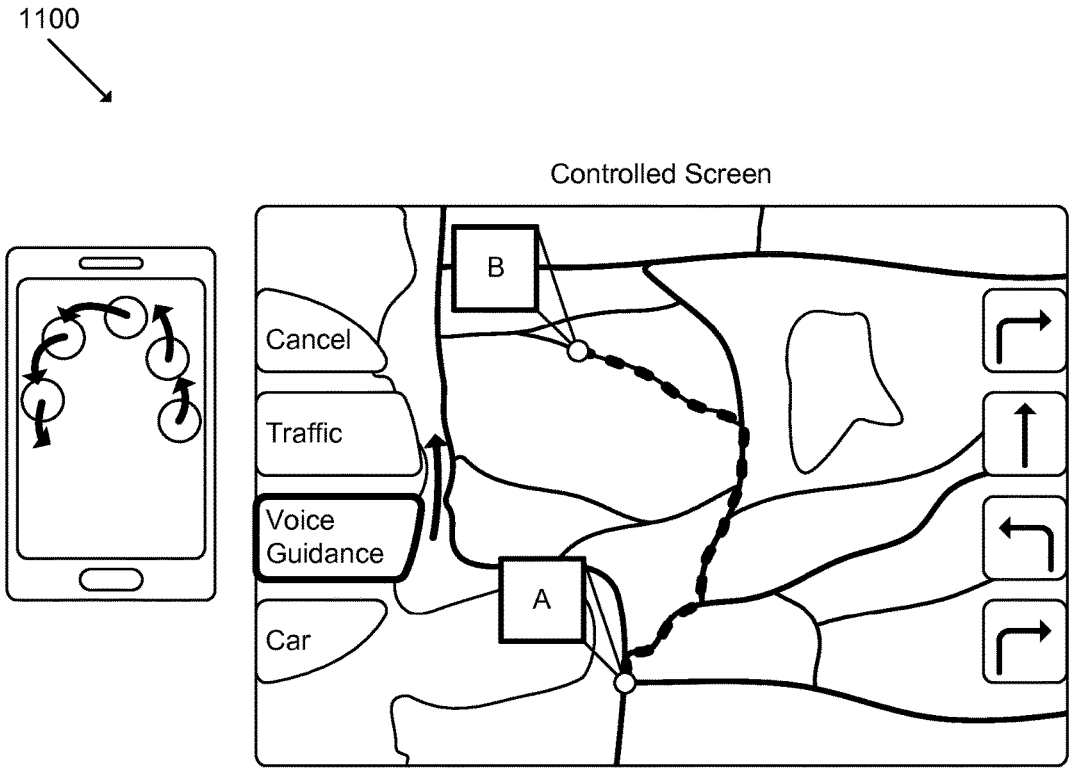
FIG. 11 illustrates an example of using rotary movement to control scrolling of commands on the left side of the map screen in some embodiments.

FIG. 11 illustrates an example 1100 of using rotary movement to control scrolling of command buttons 810 on the left side of the map screen in some embodiments. The shape of the buttons may provide a hint to the user that they can be controlled via a rotary gesture.

The above examples provide some illustrations of what can be done using gesture commands on a mobile device remote control without requiring the user to look at the mobile device or touch at a specific area on the mobile device screen. One of ordinary skill in the art will recognize that other gestures may be used. In addition, similar gestures may be applied to different commands depending on the current use of the SUC.

C. Smart Selection

An improvement over the track pad approach described above allows a user to move a UI focus indicator by dragging one finger across a controller screen. The direction of dragging may govern the direction of the focus movement.

Figure 12:
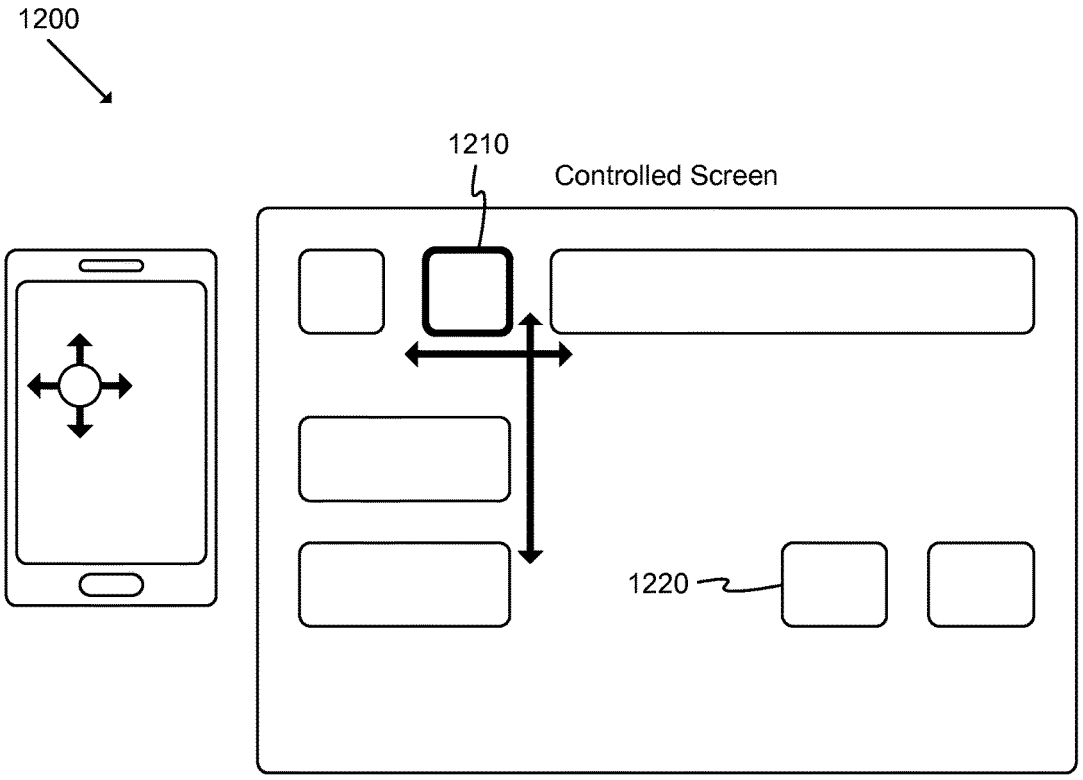
FIG. 12 illustrates an example of smart selection provided by some embodiments.

FIG. 12 illustrates an example 1200 of smart selection provided by some embodiments. In this example, a focus rectangle 1210 moves among the available control elements 1220 on the screen. If the end of the screen is reached, continuing in the same direction causes the focus selection to wrap around and continue from the other side of the screen. Depending on the type of UI, moving of the focus rectangle can initiate a select and/or enter command or the user may tap on the smartphone screen again to perform the select and/or enter command.

To make the selection less sensitive and more accurate, the RCA may require a minimum distance for the fingers to be dragged before the focus is moved to the next element. This can reduce the errors of accidental focus change. Also, when the focus is switched to a new element RCA can provide tactile or another form of feedback (e.g., sound) to the user. This way the user may be able to perform the desired action without the need to focus on the screen or "aim" the cursor as in the track pad approach. The action can thus be done faster and with less distraction. Such an approach may be especially useful in when driving a car or operating machinery.

Furthermore, the smart selection approach may be combined with other approaches (e.g., gestures, track pad, etc.). One way of doing this is to use different combinations of number of fingers being dragged to distinguish between modes. For example, one-finger dragging may use the smart selection method, two-finger dragging (sliding) may perform horizontal or vertical scrolling, and three-finger dragging may act as a track pad (for example to scroll a map). In addition, gestures may be used to perform other commands (e.g., zooming, rotary selection, etc.).

III. Other Control Features

In addition to the various touchscreen control operations described above, various other control operations may be provided by some embodiments. The sub-sections below describe various other ways of using the controller to generate control commands.

A. Controller Position and Movement

Another way to use a mobile device as a controller is to utilize the position of the device in space. Most modern smartphones (or other mobile devices) have built-in thee-axis accelerometers. Such features allow for the detection of orientation changes of the mobile device. This information may be used by the RCA to control the SUC similar to a joystick.

If the mobile device is placed parallel to the ground, for instance, tilting the device to either direction can move the UI control in that direction. Furthermore, the bigger the tilt, the faster the controlled element may be moved. Besides detecting tilt, movement of the device along an access may be used to identify various control commands. As another example, some embodiments, may allow a user to shake the device to generate a command.

Figure 13:
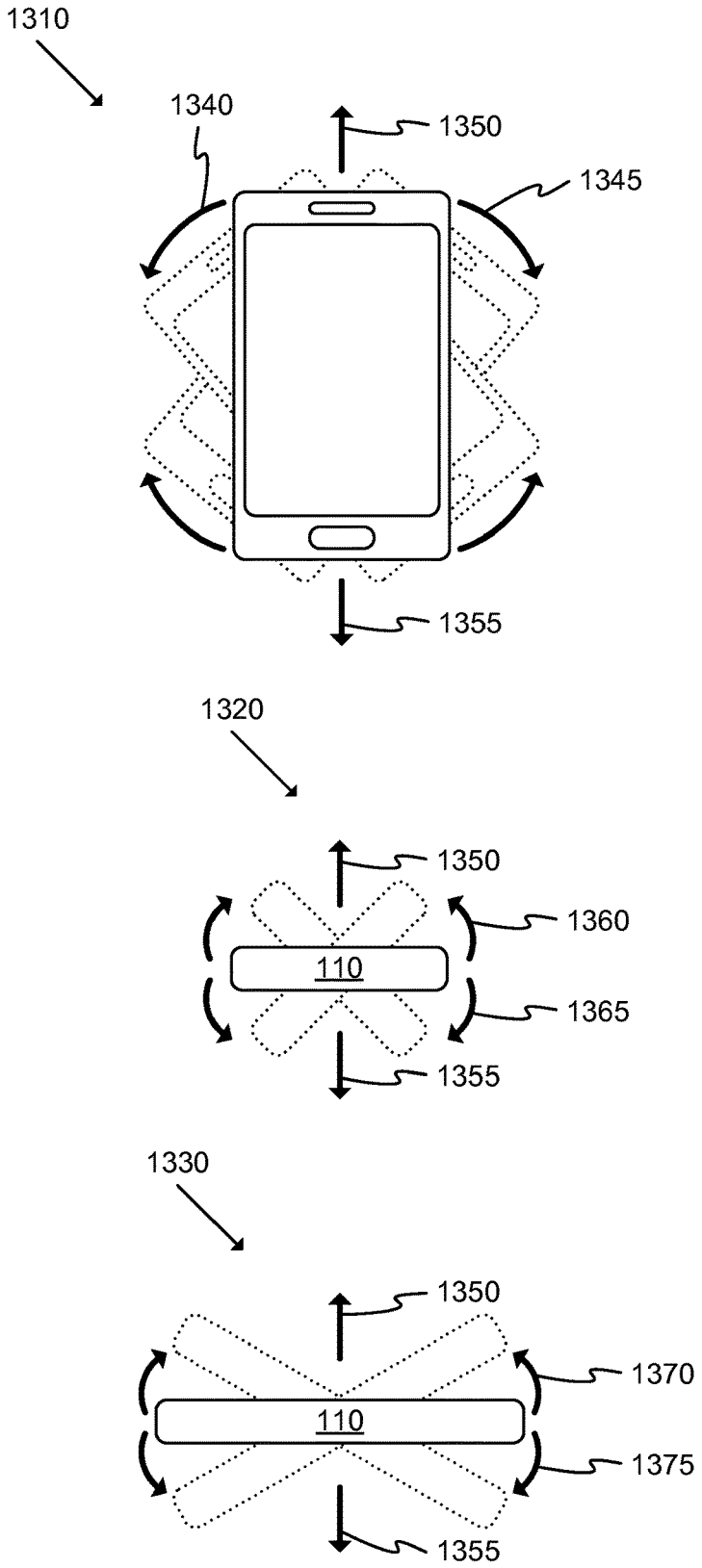
FIG. 13 illustrates various examples of device positioning and movement that may be used to generate control commands.

FIG. 13 illustrates various examples 1310-1330 of device positioning and movement that may be used to generate control commands. As shown, in a first position, the mobile device 110 may be rotated counterclockwise 1340 or clockwise 1345 to control some feature (e.g., volume). In this position, the device may be moved in a first direction 1350 along an axis and a second direction 1360 along the access to control some other feature (e.g., brightness of a display). As another example, the device may be held such that the face is parallel to the ground while the device is tilted in a first 1360 or second direction 1365 along a first axis and/or moved in other ways (e.g., in a first direction 1350 along an axis and a second direction 1360 along the axis). As yet another example, the device may be held such that the face is parallel to the ground while the device is tilted in a first 1370 or second direction 1375 along an axis perpendicular to the first axis and/or moved in other ways (e.g., in a first direction 1350 along an axis and a second direction 1360 along the axis).

Such movement features may be combined with the smart selection UI approach described above, with device tilting directing the control selection movement.

In addition to the device movements described above, various other movements may be used to control operations. For instance, the location of a controller device within a three-dimensional space may be used to control various features (e.g., raising or lowering the device to raise or lower volume, moving the device left or right to proceed through media items, shaking the device to make a selection, etc.).

B. Other Control Options

In addition to touchscreen and motion/position sensing elements, a controller of some embodiments may include other sensors that can be used as inputs for remote control applications. Several examples of such control are described below.

A camera provided by the mobile device may be used to detect proximity (e.g., when a user's hand approaches the device). The camera may also be used to detect various gestures.

A microphone provided by the mobile device may be used for voice commands. The microphone can also be used as a proximity detector or to react to a finger snap (and/or other appropriate user-generated sound) as a command. This, for example, could act as a command to wake-up the controller application of some embodiments.

This invention could be an extension to various screen projection solutions, where the mobile device is the main computing device. This would allow the screen to be placed further away from the user or allow use of a low-end display (without multi-touch capabilities) to achieve multi-touch ease of use relying only on the mobile device of a user.

Some embodiments may allow control of screens that may not otherwise be reachable, such as advertisement bill boards.

Some embodiments may allow control of medical imaging devices, where an operator may not be able to access the imaging device during use.

IV. Command Feedback

The user experience can be further improved by providing a vibration or sound feedback when a UI element is selected or a command is otherwise received.

It may be important in some application (e.g., automotive) to allow use of a mobile device as a controller without requiring a user to look at the mobile device screen. To help facilitate such use, the mobile device (i.e., the controller) may provide a feedback to the user when a selection has been made or a command has been executed.

One option is to use a vibration feature of the mobile device and thus provide tactile feedback. Most modern smartphones have an option to vibrate. This function can typically be controlled via an application programming interface (API) of the mobile device. There are also mobile devices that have tactile feedback built into their touchscreens. Some devices allow setting the duration of the vibration that can be used to provide a more realistic feedback. For example, there could be different durations depending on the selection made, such as a short duration (e.g., a five hundred millisecond vibration) when an element is selected using the smart selection feature of some embodiments and a longer vibration (e.g., a two second vibration) when an erroneous selection is made. The vibration may thus provide a tactile feedback and when combined with the touchscreen actions may simulate the sensation of a physical control (e.g., a button, switch, rotary knob, etc.).

Another way to provide feedback is to issue a sound from the mobile device. Certain sounds can even cause slight vibration to the mobile device and provide a tactile feedback in addition to the audio feedback.

V. Methods of Operation

Figure 14:
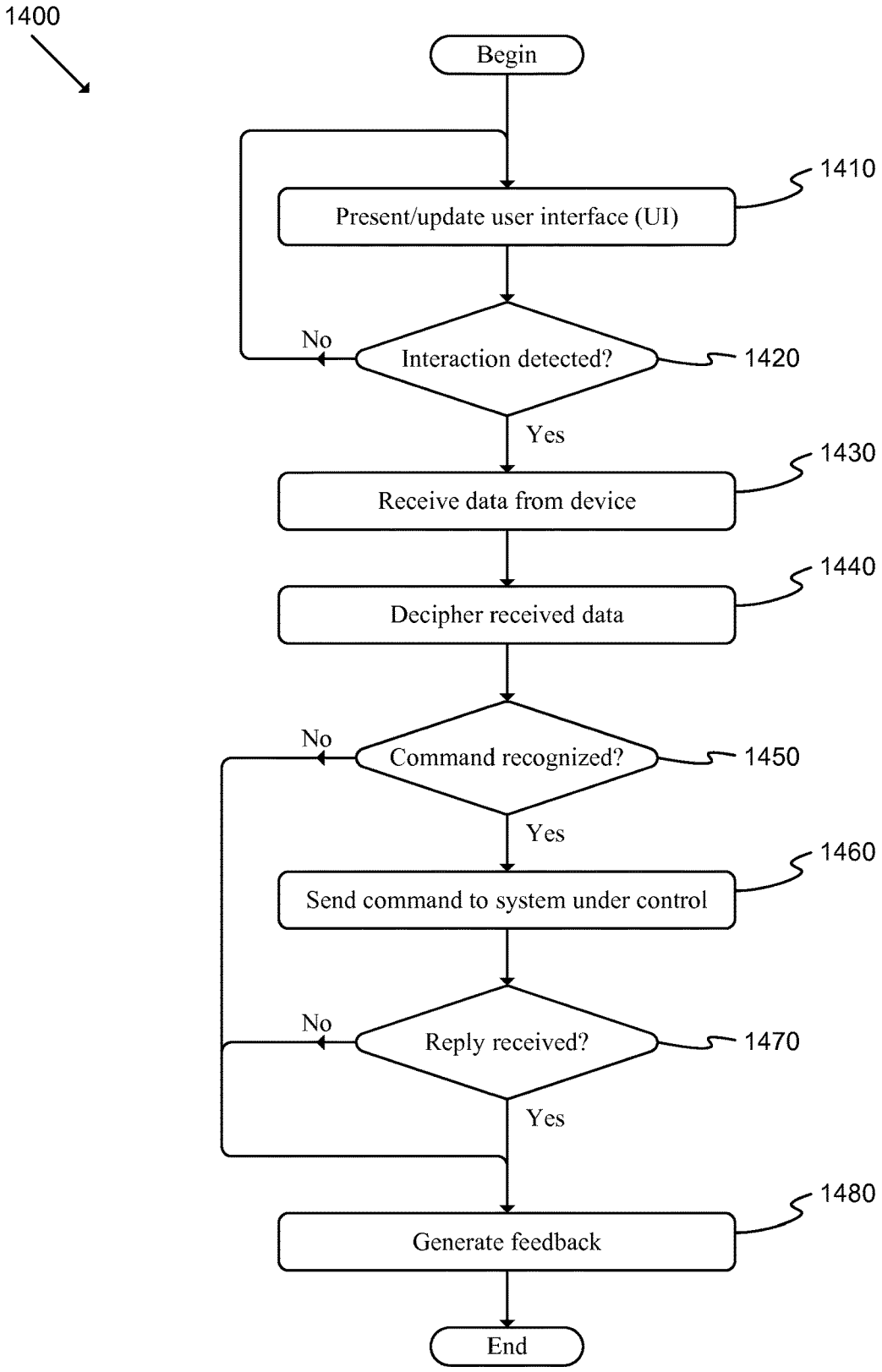
FIG. 14 illustrates a flow chart of a conceptual process used by some embodiments to provide mobile device based remote control of a system under control.

FIG. 14 illustrates a flow chart of a conceptual process 1400 used by some embodiments to provide mobile device based remote control of a SUC. Such a process may begin, for instance, when a user launches a remote controller application of some embodiments.

As shown, the process may present and/or update (at 1410) a UI. Such UIs may be similar to those described above in reference to FIG. 5. Next, process 1400 may determine (at 1420) whether any user interaction or event has been detected. Such a determination may be made based at least partly on data received from a mobile device.

If the process determines (at 1420) that no interaction has been detected, the process may repeat operations 1410-1420 until the process determines (at 1420) that an interaction has been detected. If the process determines (at 1420) that an interaction has been detected, the process may receive (at 1430) data from the device. Such data may include notification messages, touchscreen information, etc. Next, the process may decipher (at 1440) the received data. Such data may be deciphered using an interpreter as described above in reference to FIGS. 3 and 4.

Process 1400 may then determine (at 1450) whether a command is recognized and if so, sending (at 1460) a command to the SUC. Next, the process may determine (at 1470) whether a reply has been received. After determining (at 1450) that no command was recognized or after determining (at 1470) whether a reply was received, the process may generate (at 1480) feedback and then end. Such feedback may include haptic feedback, visual feedback, audio feedback, and/or other appropriate feedback. The feedback may differ depending on whether a command was recognized and/or whether a reply was received in order to allow a user to determine whether a remote command was completed.

Figure 15:
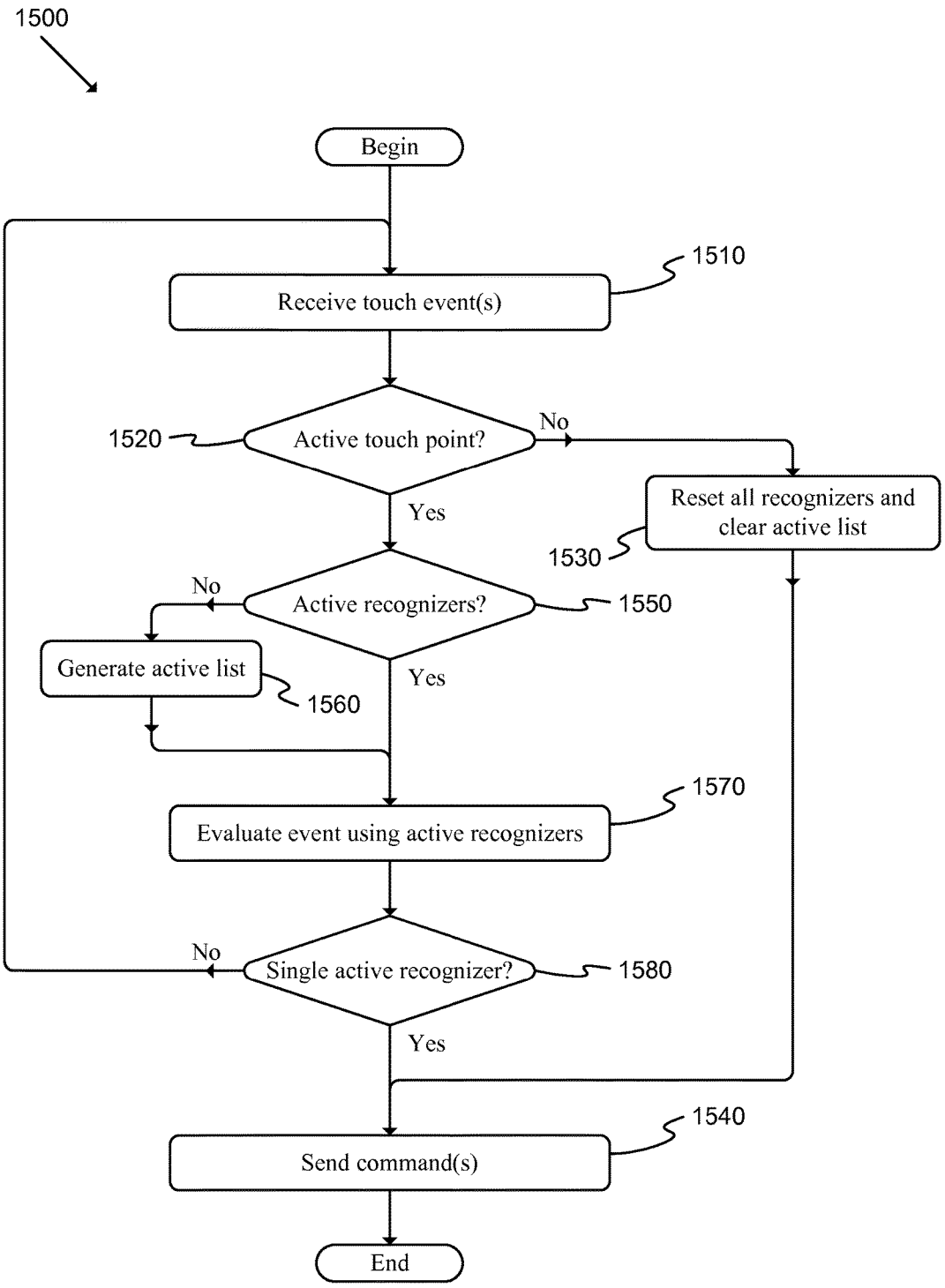
FIG. 15 illustrates a flow chart of a conceptual process used by some embodiments to decipher commands.

FIG. 15 illustrates a flow chart of a conceptual process 1500 used by some embodiments to decipher commands. Similar processes may be used to decipher commands received from other input sources. The process may be performed by a module such as the command interpreter 300 described above. Process 1500 may begin, for instance, when a touchscreen is manipulated by a user.

Next, the process may receive (at 1510) touch events. Such events may be received over the link 350 described above. Next, the process may determine (at 1520) whether any touch points are active. If the process determines that no touch points are active, the process may reset (at 1530) all recognizers in the active list and clear the active list. The process may then send (at 1540) one or more commands and then end. If a single command was sent before determining that no touch points are active, a command complete message may be sent. If a cancel gesture was received a cancel command may be sent to the SUC such that the previous command may be canceled or ignored. If no command was identified, an appropriate message may be sent and used to provide user feedback. Such commands may be sent by, for example, notification module 340 described above.

If the process determines (at 1520) that one or more touch points are active, the process may then determine (at 1550) whether there are any active recognizers. Such a determination may be made by evaluating the active recognizer list of some embodiments. If the process determines that there are no active recognizers, the process may generate (at 1560) an active list. Such a list may be generated by, for instance, the recognizer module 320. If the process determines (at 1550) that there are active recognizes or after generating (at 1560) an active list, the process may evaluate (at 1570) the received event(s) using the active recognizers.

In order to evaluate the received event(s), the process may iteratively proceed through the list of active recognizers. For each recognizer, the received event may be passed to the recognizer. The recognizer may then evaluate the event data to see if the event satisfies some evaluation criteria such as whether the new event conforms to a gesture pattern. For example, a pinch may be identified if two touch points are moving toward or away from each other. As another example, a swipe may be identified if two touch points are moving in the same direction. As still another example, a rotary event may be identified if a specified number of touch points are determined to be moving in a circular direction. If the new event falls within the recognized pattern, the recognizer may set or keep its state as active. If the new event falls outside the recognized pattern (or other appropriate criteria), the recognizer may reset its state to not active. Each non-active recognizer may be removed from the list.

Next, process 1500 may determine (at 1580) whether only one recognizer is active. If the process determines that multiple recognizers are active, the process may repeat operations 1510-1580 until the process determines (at 1580) that a single recognizer is active. If the process determines that a single recognizer is active, the process may send (at 1540) one or more command messages and then end. Such command messages may be sent by, for example, notification module 340 described above. The command message may include the command associated with the active recognizer. In addition, the command message may include various command parameters associated with the command (e.g., amount of rotation, distance and/or speed of a swipe gesture, etc.).

One of ordinary skill in the art will recognize that processes 1400-1500 are conceptual in nature and may be implemented in various different ways without departing from the spirit of the invention. For instance, the various operations may be performed in different orders than shown. As another example, various other operations may be included and/or various operations may be omitted. Each process may be divided into multiple sub-processes or may be included as a sub-process of a larger macro process. Each process (or potion thereof) may be performed at regular intervals, continuously, and/or as is otherwise appropriate.

VI. Computer System

Many of the processes and modules described above may be implemented as software processes that are specified as one or more sets of instructions recorded on a non-transitory storage medium. When these instructions are executed by one or more computational element(s) (e.g., microprocessors, microcontrollers, Digital Signal Processors (DSPs), Application-Specific ICs (ASICs), Field Programmable Gate Arrays (FPGAs), etc.) the instructions cause the computational element(s) to perform actions specified in the instructions.

In some embodiments, various processes and modules described above may be implemented completely using electronic circuitry that may include various sets of devices or elements (e.g., sensors, logic gates, analog to digital converters, digital to analog converters, comparators, etc.). Such circuitry may be adapted to form devices or elements that are able to perform functions and/or features that may be associated with various software elements described throughout.

Figure 16:
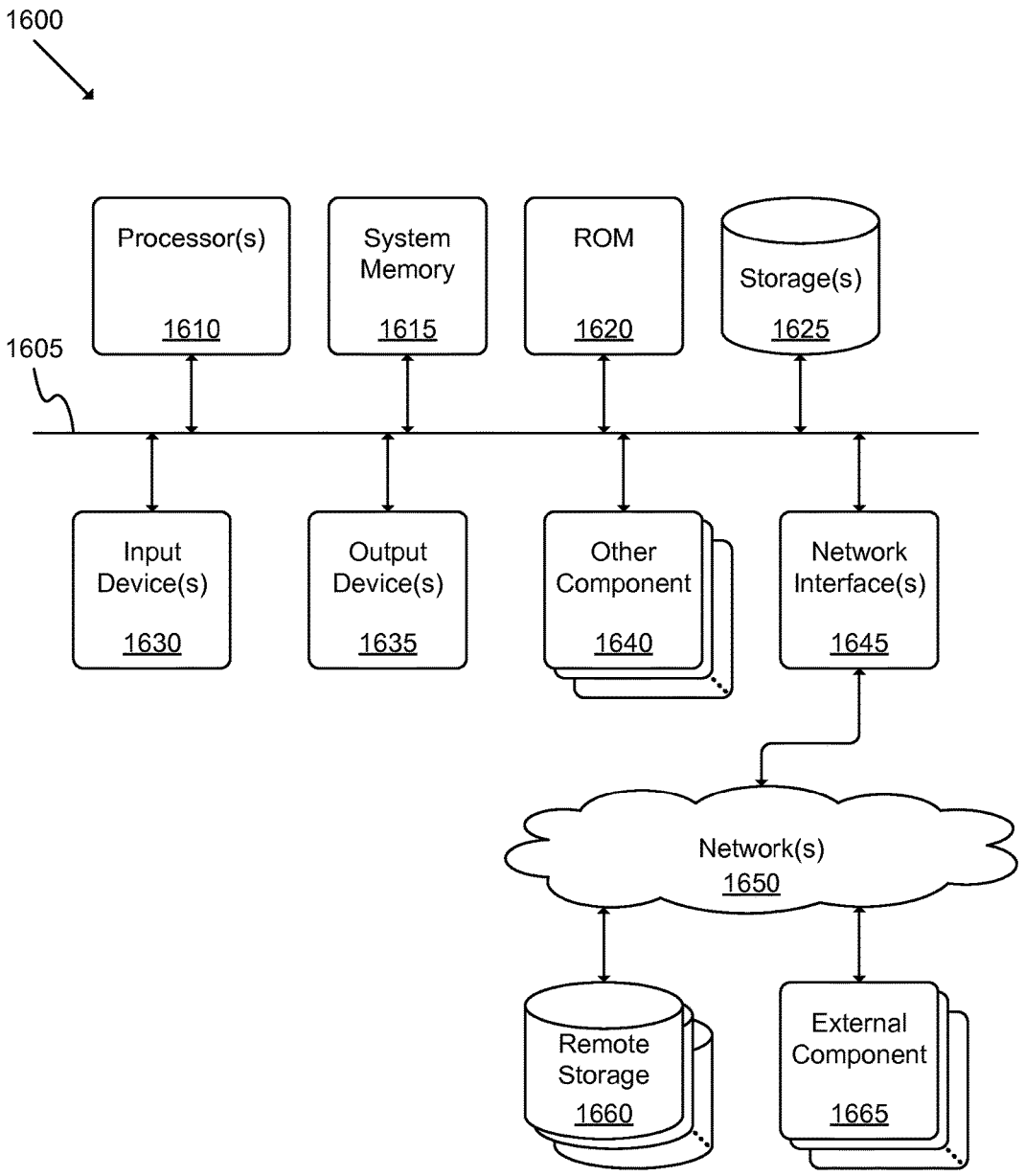
FIG. 16 conceptually illustrates a schematic block diagram of a computer system with which some embodiments of the invention may be implemented.

FIG. 16 illustrates a schematic block diagram of a conceptual computer system 1600 used to implement some embodiments of the invention. For example, the systems described above in reference to FIGS. 1 and 2 may be at least partially implemented using computer system 1600. As another example, the processes described in reference to FIGS. 14-15 may be at least partially implemented using sets of instructions that are executed using computer system 1600.

Computer system 1600 may be implemented using various appropriate devices. For instance, the computer system may be implemented using one or more personal computers ("PC"), servers, mobile devices (e.g., a smartphone), tablet devices, and/or any other appropriate devices. The various devices may work alone (e.g., the computer system may be implemented as a single PC) or in conjunction (e.g., some components of the computer system may be provided by a mobile device while other components are provided by a tablet device).

As shown, computer system 1600 may include at least one communication bus 1605, one or more processors 1610, a system memory 1615, a read-only memory (ROM) 1620, permanent storage devices 1625, input devices 1630, output devices 1635, various other components 1640 (e.g., a graphics processing unit), and one or more network interfaces 1645.

Bus 1605 represents all communication pathways among the elements of computer system 1600. Such pathways may include wired, wireless, optical, and/or other appropriate communication pathways. For example, input devices 1630 and/or output devices 1635 may be coupled to the system 1600 using a wireless connection protocol or system.

The processor 1610 may, in order to execute the processes of some embodiments, retrieve instructions to execute and/or data to process from components such as system memory 1615, ROM 1620, and permanent storage device 1625. Such instructions and data may be passed over bus 1605.

System memory 1615 may be a volatile read-and-write memory, such as a random access memory (RAM). The system memory may store some of the instructions and data that the processor uses at runtime. The sets of instructions and/or data used to implement some embodiments may be stored in the system memory 1615, the permanent storage device 1625, and/or the read-only memory 1620. ROM 1620 may store static data and instructions that may be used by processor 1610 and/or other elements of the computer system.

Permanent storage device 1625 may be a read-and-write memory device. The permanent storage device may be a non-volatile memory unit that stores instructions and data even when computer system 1600 is off or unpowered. Computer system 1600 may use a removable storage device and/or a remote storage device 1660 as the permanent storage device.

Input devices 1630 may enable a user to communicate information to the computer system and/or manipulate various operations of the system. The input devices may include keyboards, cursor control devices, audio input devices and/or video input devices. Output devices 1635 may include printers, displays, and/or audio devices. Some or all of the input and/or output devices may be wirelessly or optically connected to the computer system.

Other components 1640 may perform various other functions. These functions may include performing specific functions (e.g., graphics processing, sound processing, etc.), providing storage, interfacing with external systems or components, etc.

Finally, as shown in FIG. 16, computer system 1600 may be coupled to one or more networks 1650 through one or more network interfaces 1645. For example, computer system 1600 may be coupled to a web server on the Internet such that a web browser executing on computer system 1600 may interact with the web server as a user interacts with an interface that operates in the web browser. Computer system 1600 may be able to access one or more remote storages 1660 and one or more external components 1665 through the network interface 1645 and network 1650. The network interface(s) 1645 may include one or more application programming interfaces (APIs) that may allow the computer system 1600 to access remote systems and/or storages and also may allow remote systems and/or storages to access computer system 1600 (or elements thereof).

As used in this specification and any claims of this application, the terms "computer", "server", "processor", and "memory" all refer to electronic devices. These terms exclude people or groups of people. As used in this specification and any claims of this application, the term "non-transitory storage medium" is entirely restricted to tangible, physical objects that store information in a form that is readable by electronic devices. These terms exclude any wireless or other ephemeral signals.

It should be recognized by one of ordinary skill in the art that any or all of the components of computer system 1600 may be used in conjunction with the invention. Moreover, one of ordinary skill in the art will appreciate that many other system configurations may also be used in conjunction with the invention or components of the invention.

In addition, while the examples shown may illustrate many individual modules as separate elements, one of ordinary skill in the art would recognize that these modules may be combined into a single functional block or element. One of ordinary skill in the art would also recognize that a single module may be divided into multiple modules.

The foregoing relates to illustrative details of exemplary embodiments of the invention and modifications may be made without departing from the spirit and scope of the invention as defined by the following claims.

We claim:

1. A remote controller that interacts with a system under control (SUC), the remote controller comprising:

at least one input able to receive data from a user, wherein the at least one input includes at least one touchscreen input able to receive data associated with touchscreen movement gestures comprising a plurality of touch points on a surface of the touchscreen input;

a command interpreter able to evaluate data received via the at least one input and determine whether the received data is associated with a remote command from among a set of remote commands associated with the SUC, wherein each remote command in the set of remote commands is associated with a movement path along the surface of the touchscreen input, wherein the movement path comprises one of the plurality of touch points, wherein at least one command from among the set of remote commands is associated with a touchscreen gesture comprising at least two touch points;

at least one communication element that sends remote commands to at least one of the SUC and multiple external systems; and at least one haptic feedback element that provides feedback to the user when determining that the received data is associated with a remote command from among the set of remote commands associated with the SUC, wherein:

the SUC is an in-vehicle system comprising a display that provides a screen comprising a plurality of UI elements, wherein a shape of each UI element in the plurality of UI elements indicates a gesture type associated with each UI element.

2. The remote controller of claim 1, wherein at least one command from among the set of remote commands is associated with a touchscreen movement gesture comprising at least two touch points and at least two movement paths.

3. The remote controller of claim 1, wherein the communication element is adapted to communicate with the SUC over a wireless link.

4. The remote controller of claim 1, wherein the at least one input includes at least one position sensing input comprising at least one accelerometer.

5. The remote controller of claim 1, wherein the haptic feedback element is adapted to be able to cause the remote controller to vibrate.

6. An automated method that deciphers a user input event, the method comprising:

generating a list of active recognizers, each recognizer comprising a type and a set of configuration parameters, wherein the set of configuration parameters includes a movement threshold associated with each touch point among a plurality of touch points along a surface of a touchscreen input;

passing data associated with the user input event to each recognizer in the list of active recognizers, wherein the user input event comprises capturing audio information;

determining a status for each recognizer in the list of active recognizers by:

comparing the data associated with the user input event to a set of evaluation criteria associated with the recognizer;

determining whether the user input event satisfies the evaluation criteria and setting the status to active if the user input event satisfies the evaluation criteria; and resetting the status to inactive and removing the recognizer from the list of active recognizers if the user input event does not satisfy the evaluation criteria, wherein the user input event comprises a touchscreen input and the evaluation criteria comprises a gesture pattern associated with at least two touch points;

identifying a single recognizer based at least partly on the status of each recognizer, wherein the user input event is associated with an in-vehicle system comprising a display that provides a screen comprising a plurality of UI elements, wherein a shape of each UI element in the plurality of UI elements indicates a gesture type associated with each UI element; and retrieving a command associated with the single recognizer for transmission to the in-vehicle system.

7. The automated method of claim 6, wherein the evaluation criteria comprises a movement gesture pattern associated with at least two touch points, wherein the gesture pattern comprises a movement path along a surface of the touchscreen input, the movement path including at least one of the at least two touch points.

8. The automated method of claim 6, wherein the user input event comprises position information.

9. The remote controller of claim 1, wherein the remote controller is a mobile device.

* * * * *